US006450271B1

(12) United States Patent
Tibbitts et al.

(10) Patent No.: US 6,450,271 B1
(45) Date of Patent: Sep. 17, 2002

(54) SURFACE MODIFICATIONS FOR ROTARY DRILL BITS

(75) Inventors: Gordon A. Tibbitts, Salt Lake City, UT (US); Danny E. Scott, Montgomery, TX (US); James L. Overstreet, Tombell, TX (US); Terry J. Kolterman, The Woodlands, TX (US); Chih Lin, Spring, TX (US); James Andy Oxford, Conroe, TX (US); Steven R. Radford, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/621,064

(22) Filed: Jul. 21, 2000

(51) Int. Cl.[7] ..... E21B 10/00
(52) U.S. Cl. ..... 175/374; 175/425; 76/108.2
(58) Field of Search ..... 175/425, 340, 175/372, 374, 371; 76/108.2

(56) References Cited

U.S. PATENT DOCUMENTS

| | | | | |
|---|---|---|---|---|
| 2,660,405 A | | 11/1953 | Scott et al. | |
| 2,833,638 A | | 5/1958 | Owen | |
| 3,301,339 A | | 1/1967 | Pennebaker, Jr. | |
| 3,329,601 A | | 7/1967 | Mattox | |
| 3,453,719 A | | 7/1969 | Feenstra | |
| 3,488,892 A | | 1/1970 | Benner et al. | |
| 3,788,407 A | | 1/1974 | Lorenz et al. | |
| 4,054,426 A | | 10/1977 | White | |
| 4,173,457 A | | 11/1979 | Smith | |
| 4,253,533 A | | 3/1981 | Baker, III | |
| 4,525,178 A | * | 6/1985 | Hall | 51/309 |
| 4,665,996 A | | 5/1987 | Foroulis et al. | |
| 4,883,132 A | | 11/1989 | Tibbitts | |
| 5,163,524 A | | 11/1992 | Newton, Jr. et al. | |
| 5,199,511 A | | 4/1993 | Tibbitts et al. | |
| 5,279,374 A | | 1/1994 | Sievers et al. | |
| 5,291,807 A | | 3/1994 | Vanderford et al. | |
| 5,295,549 A | * | 3/1994 | Dolezal et al. | 175/371 |
| 5,330,016 A | | 7/1994 | Paske et al. | |
| 5,332,050 A | | 7/1994 | Huval | |
| 5,337,844 A | | 8/1994 | Tibbitts | |
| 5,447,208 A | | 9/1995 | Lund et al. | |
| 5,509,490 A | | 4/1996 | Paske et al. | |
| 5,644,956 A | * | 7/1997 | Blackman et al. | 76/108.2 |
| 5,653,300 A | | 8/1997 | Lund et al. | |
| 5,655,611 A | | 8/1997 | Dolezal et al. | |
| 5,677,042 A | * | 10/1997 | Massa et al. | 428/212 |
| 5,791,421 A | | 8/1998 | Lin | |
| 5,791,422 A | * | 8/1998 | Liang et al. | 175/374 |
| 6,006,846 A | | 12/1999 | Tibbitts et al. | |
| 6,145,608 A | | 11/2000 | Lund et al. | |

FOREIGN PATENT DOCUMENTS

| | | |
|---|---|---|
| EP | 0 656 458 A2 | 6/1995 |
| EP | 0 890 705 A2 | 1/1999 |

OTHER PUBLICATIONS

UK Search Report of Oct. 18, 2001 (Application No. GB 0117746.8).

Roy, Sanjit, et al., "Prevention of Bit Balling in Shales: Some Preliminary Results," IADC/SPE 23870, 1992, pp. 259–268.

"Surface Treatments for Downhole Drill Bits," Research Disclosure, 36121, May 1994.

Smith, Lee, et al., "Successful Field Application of an Electro–Negative 'Coating' to Reduce Bit Balling Tendencies in Water Based Mud," IADC/SPE 35110, 1996, pp. 547–557.

Search Report dated Apr. 27, 1998.

* cited by examiner

*Primary Examiner*—David Bagnell
*Assistant Examiner*—Daniel P Stephenson
(74) *Attorney, Agent, or Firm*—TraskBritt

(57) ABSTRACT

A rotary-type drill bit for drilling subterranean formations having areas or components having surfaces exhibiting a relatively low adhesion, preferably nonwater-wettable, surface over at least a portion thereof.

55 Claims, 9 Drawing Sheets

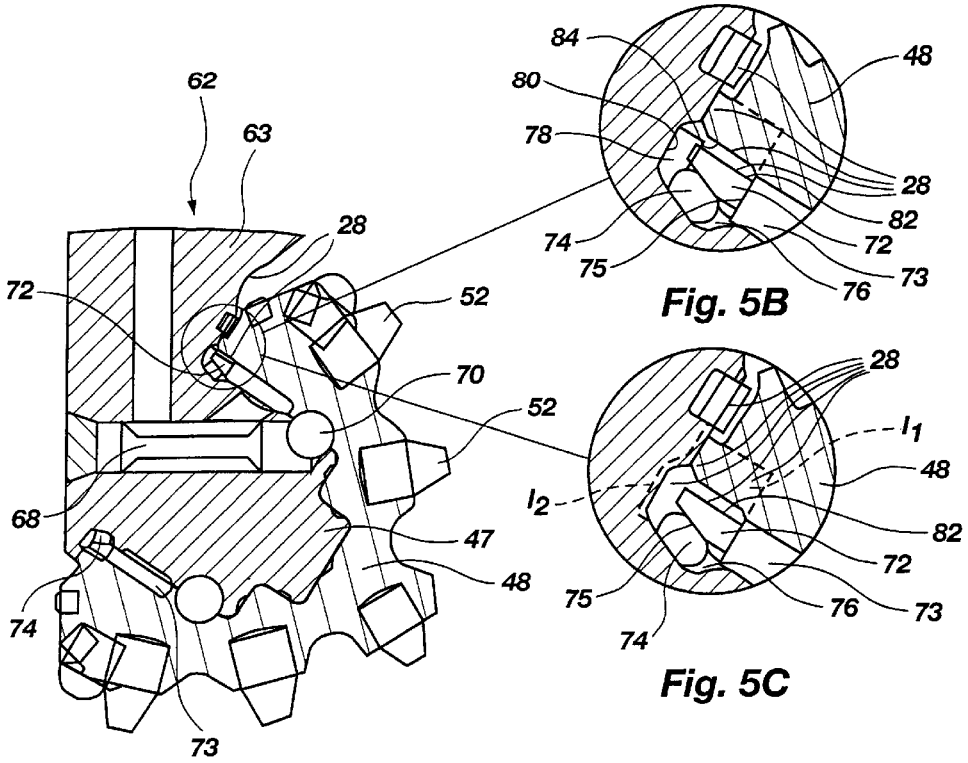
Fig. 5A
Fig. 5B
Fig. 5C
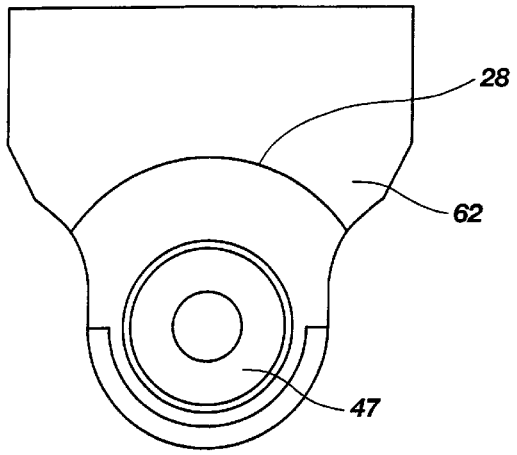
Fig. 5E
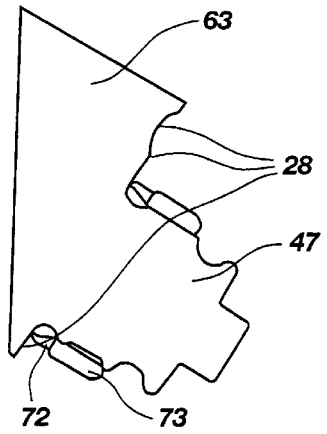
Fig. 5D

SURFACE MODIFICATIONS FOR ROTARY DRILL BITS

BACKGROUND OF THE INVENTION

1. Field of the Invention

This invention relates generally to drill bits for drilling into subterranean formations and methods of manufacturing the same, wherein such bits include at least one surface to which formation material exhibits relatively low-adhesion, the low-adhesion surface being effected by coating, plating, or otherwise treating that portion of the bit such as by mechanical or thermal processing.

2. State of the Art

Rotary-type drill bits include both rotary drag bits and roller-cone bits. Typically, in a rotary drag bit, fixed cutting elements made of natural diamond or polycrystalline diamond in the form of polycrystalline diamond compacts (PDCs) are attached to the face of the drill bit, either as freestanding, unbacked cutters or, where suitably configured, mounted or a stud, cylinder or other carrier. The cutters on the bit face are typically adjacent to waterways or fluid courses extending to passageways or "junk slots" formed in the side or gage surface of the bit body above the bit face (as the bit is oriented for drilling) to allow drilling fluid with entrained material (cuttings) that has been cut from the formation to pass upwardly around the bit and into the borehole thereabove.

In a roller-cone arrangement, the bit typically has three cones, each independently rotatable with respect to the bit body supporting the cones through bearing assemblies. The cones carry either integrally formed teeth or separately formed inserts that provide the cutting action of the bit. The spaces between the teeth or inserts on the cones and between the legs of the bit to which the cones are mounted provide a passage for drilling fluid and formation cuttings to enter the borehole above the bit.

When drilling a hole with prior art drill bits, the cuttings may adhere to, or "ball up" on, the surface of the drill bit. The cuttings thus tend to accumulate on the cutting elements and the surfaces of the drill bit and collect in any void, gap or recess created between the various structural components of the bit. This phenomenon is particularly enhanced in formations that fail plastically, such as certain shales, mudstones, siltstones, limestones and other ductile formations, the cuttings from which may become mechanically packed in the aforementioned voids, gaps or recesses on the drill bit exterior. In other cases, such as when drilling certain shale formations, the adhesion between a bit surface and the formation cuttings is most probably, or in many instances, caused by a chemical bond. When the surface of a bit becomes water wet in such formations, the bit surface and clay layers of the shale share common hydrogen electrons. A similar sharing of electrons is present between the individual sheets of the shale itself A result of this sharing of electrons is an adhesive-type bond between the shale and the bit surface. Adhesion between the formation cuttings and the bit surface may also occur when the charge of the bit face is opposite the charge of the formation, the oppositely charged formation particles tending to adhere to the surface of the bit. Moreover, particles of the formation may actually be compacted onto exterior surfaces of the bit or mechanically bonded into pits or trenches etched into the bit by erosion and abrasion during the drilling process.

Attempts have been made to alleviate the aforementioned electrical charge-induced adhesion tendencies as disclosed in U.S. Pat. Nos. 5,330,016 and 5,509,490 and in two IADE/SPE papers respectively referenced as IADC/SPE 23870, Roy et al., "Prevention of Bit Balling in Shales; Some Preliminary Results" and IADC/SPE 35110, Smith et al., "Successful Field Application of an Electro-Negative 'Coating' to Reduce Bit Balling Tendencies in Water Based Mud."

If cuttings become stuck to the surface of the drill bit, subsequent cuttings are not allowed to simply slide along the surface of the cutters and through the junk slots. The subsequent cuttings must, in effect, slide over formation material already attached to the surface of the bit. Thus, a shearing force is created between the cuttings stuck to the bit and subsequent cuttings. As a result, much greater frictional forces between the drill bit and the formation are produced, which forces may result in a reduced rate of penetration and result in further accumulation of cuttings on the bit.

One approach in the art to remove this adhered formation material from the bit has been to provide nozzles in the bit body to direct drilling fluid from an interior plenum of the bit to the surface of the cutters. For example, in U.S. Pat. No. 4,883,132 to Tibbitts, to reduce bit balling, nozzles are provided that direct drilling fluid to impact the formation cuttings as they leave the cutting faces of the cutters. In some instances, however, the high velocity drilling fluid may not adequately remove the cuttings from the cutting elements. Moreover, the directed drilling fluid is not effective to remove cuttings from the bit face or junk slots of the bit.

The need to reduce frictional forces in the drilling process has been addressed in U.S. Pat. No. 4,665,996 to Foroulis et al. Foroulis discloses the application of a hard facing material to the surface of a drill pipe. The hard facing material is purported to reduce the friction between the drill string and the casing or rock. As a result, the torque needed for the rotary drilling operation, especially directional drilling, is decreased.

U.S. Pat. Nos. 5,447,208 and 5,653,300 to Lund et al. also disclose a way to reduce frictional forces associated with drilling, wherein the superabrasive cutting face of a cutting element is polished to a surface finish roughness of 10 $\mu$ in. or less.

There have been many instances in which a portion or all of certain drill bit and drilling tool surfaces have been coated with a layer of another material to promote wear resistance. For example, U.S. Pat. No. 5,163,524 to Newton et al. discloses application of a smooth, hard facing layer of an abrasion-resistant material to gage pads, the materials being suggested as suitable including a matrix material (WC) or a layer of CVD-applied "polycrytalline" diamond. U.S. Pat. No. 4,054,426 to White suggests treating the surfaces of roller bit cones with a high particulate level ion plating process to form a dense, hard, smooth, thin film. U.S. Pat. No. 4,173,457 to Smith discloses hard facing of mining and drilling tools with sintered tungsten carbide-cobalt particles and with sintered or cemented chromium carbide particles. Of course, the use of tungsten carbide as a hard facing layer on drill bits has been known for decades, as disclosed in U.S. Pat. No. 2,660,405 to Scott et al., U.S. Pat. No. 2,883,638 to Owen and U.S. Pat. No. 3,301,339 to Pennebaker. Patterned hard facing on roller bit cones has been suggested in U.S. Pat. No. 5,291,807 to Vanderford et al., "carbide" being suggested as a suitable material. Finally, U.S. Pat. No. 5,279,374 to Sievers et al. teaches the continuous or uninterrupted coating of rollercones carrying inserts with refractory material such as tungsten carbide.

None of the foregoing approaches to bit and cutter design, however, have specifically addressed the need to reduce frictional forces created by cuttings adhering to the bit body or bit components other than cutting elements. More specifically, the prior art has not addressed the effects of friction due to buildup of formation material at or proximate gaps, voids or other discontinuities created at interfaces between the cutters and the cutting face, the nozzles and the bit face, the roller-cone surfaces and inserts, or other points where parts of the bit are joined together or exterior surfaces of the bit join at sharp angles. Accordingly, it would be advantageous to provide a drill bit that reduces or eliminates adhesion of formation cuttings to the drill bit. It would also be advantageous to provide a method of treatment of at least selected portions of exposed surfaces of a bit that might be implemented on any drill bit regardless of shape, size or style.

BRIEF SUMMARY OF THE INVENTION

The present invention provides a rotary-type drill bit for drilling subterranean formations and method of making the same. The bit according to the invention includes a surface treatment exhibiting relatively low adhesion for formation materials which extends over at least a portion of a bit surface exposed to drilling fluid. Advantages of such low-adhesion surface treatment of the invention include a reduction of bit balling, reduced frictional forces during the drilling process, and decreased erosion on the exposed surface of the drill bit.

In a more particular aspect of the invention, a nonwater-wet surface treatment comprised at least in part of a material such as an elastomer, plastic or precious metal or a superabrasive material, is applied to at least a portion of the exposed bit surface to prevent bit balling resulting from chemical bonds forming between hydrogen ions present in the clay unit layers of shale, as well as in other previously enumerated formations, and surfaces of the bit. Especially in areas on the bit face with low drilling fluid velocities thereover, such a treatment prevents the accumulation of cuttings, and consequent bit balling. Nonwater-wet surfaces do not possess hydrogen atoms to be shared with the formation material.

Also in accordance with the invention, a treatment material applied to the exposed bit surface may be polished, ground, lapped or otherwise processed by methods known in the art to create a smooth, low-adhesion surface which is also nonwater-wet.

Further in accordance with the invention, a surface treatment may comprise not only a treatment directly on a surface of a drill bit component but also a surface treatment on a surface of a preformed insert configured to provide such a surface treatment for a drill bit to which such insert is secured, or a preformed insert substantially, or even entirely, comprising a surface treatment material, the insert being secured to the drill bit component.

Advantages provided by a reduced roughness bit surface include increased rate of penetration because of reduced sliding frictional forces between the bit and the formation being drilled as well as reduced erosion of the bit and cutting elements (and particularly of the substrates and other carrier structures and the bit material adjacent pockets or apertures into which they are inserted). Furthermore, surface treatments according to the invention are easily applied to any shape, size or style of drill bit.

The foregoing and other features and advantages of the invention will become more readily apparent from the following detailed description of the preferred embodiments, which proceeds with reference to the drawings appended hereto.

BRIEF DESCRIPTION OF THE DRAWINGS

FIG. 5A comprises a side sectional view similar to FIG. 5 of one cone and an associated bit body portion including a cantilevered bearing shaft illustrating surface treatments on the interior of the bit in accordance with the present invention, FIG. 5B is an enlargement of a portion of FIG. 5A depicting locations of surface treatments in a configuration of the bit utilizing a backup ring, FIG. 5C is an enlargement of FIG. 5A depicting locations of surface treatments in a configuration of the bit without a backup ring, FIG. 5D is a side elevation of a bit body portion with bearing shaft extending therefrom, and FIG. 5E is a frontal elevation of the bearing shaft and bit body section from a perspective along the longitudinal axis of the bearing shaft, showing the area of the bit body portion to be treated;

DETAILED DESCRIPTION OF THE PREFERRED EMBODIMENTS

Figure 1:
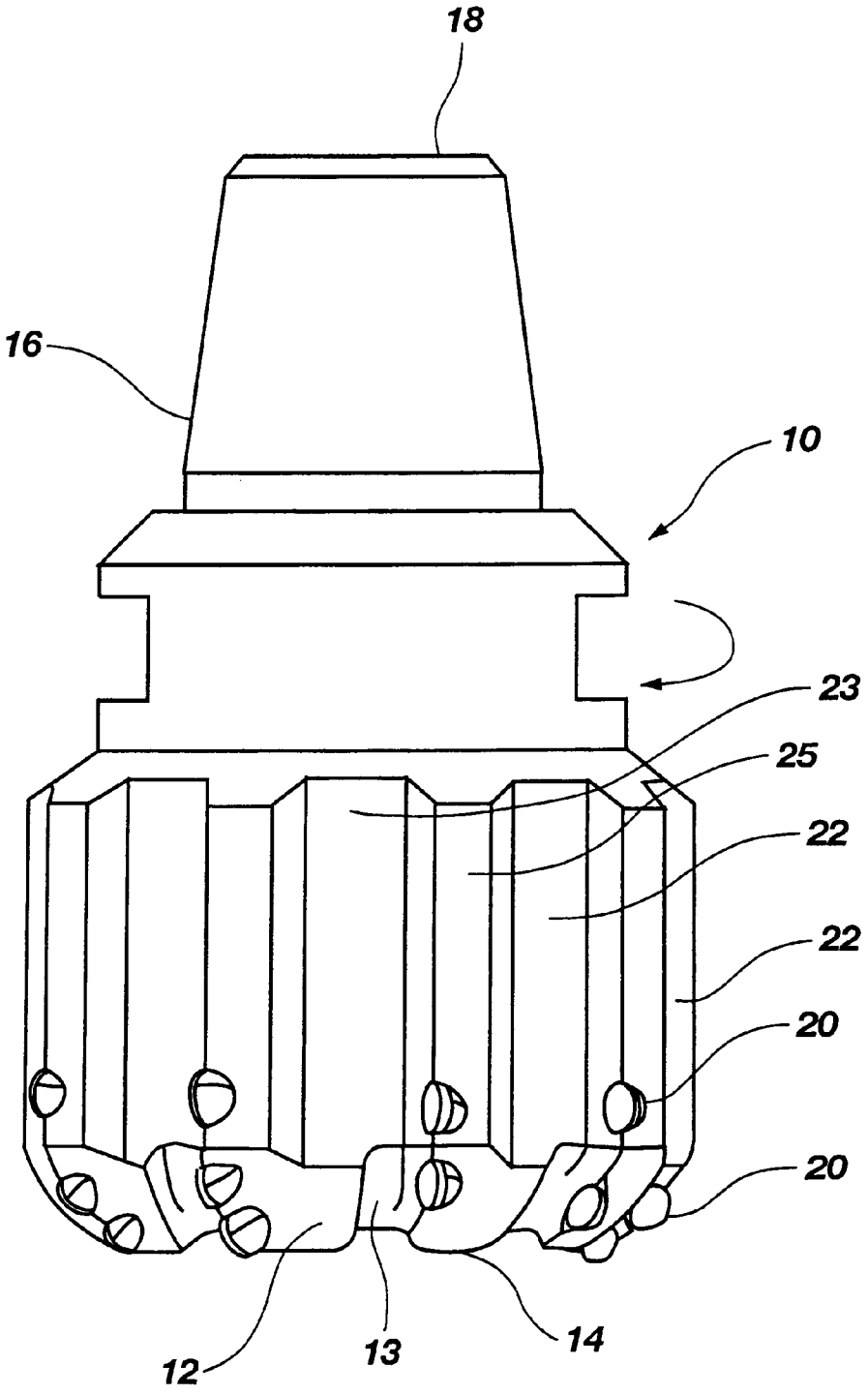
FIG. 1 is a diagrammatic side elevation of a rotary drag bit in accordance with the present invention.

Various materials known in the art may be used to provide a relatively low adhesion or smooth, exposed surface on a drill bit according to the invention. For example, urethanes or other polymers or other nonmetallic, hard materials may be utilized, particularly where direct contact with the formation being drilled is not a concern. Urethanes are especially suitable as they are abrasion- and erosion-resistant, producible in a variety of durometers, and "give" or yield resiliently to absorb energy. Urethanes as well as epoxies exhibit good adhesion characteristics to the metals of which drill bits are conventionally formed. In low-flow areas where abrasive-laden fluid-induced scouring is less likely to occur, plastic or other polymer coatings may be used. These coatings may be attached to a tungsten carbide matrix-type bit by leaching away the cobalt between the grains of tungsten carbide and filling these void spaces with a coating material. Epoxies filled with erosion-resistant material such as tungsten carbide (up to about 60% by volume) may be adhered to the bit surface. Porous metal, cermet or ceramic coatings filled with plastics, other polymers or epoxies may also be employed. The bit may also be electrolessly plated, electrochemically plated, ion plated, flame sprayed, or treated by methods known in the art with a material such as nickel, chromium copper, magnesium, cobalt, alloys thereof, noble metals or other plating materials or combinations thereof known in the art including silicon nitride and cermet coatings. Precious metals such as gold or silver, and alloys thereof, may also be employed, but placement thereof should be carefully selected due to limited wear resistance. Ion plating is particularly suitable for application of precious metals, nickel, chrome and their alloys.

To prevent, or reduce the tendency of, clay particles and larger, agglomerated masses thereof from sticking to the body or other features of a drill bit, the bit or selected portions thereof may be treated by coating with a codeposited layer of electroless nickel and polytetrafluoroethylene (offered under the trade name Teflon®). Such materials are commercially available from different vendors under a variety of trade names, including NYE-TEF, Enlon, Niflor, Niklon, and others. Such materials have been used commercially to coat dies, screws and mold interiors (eliminating the need for a mold release spray), but to the inventors' knowledge have not been used as proposed herein. Combined with local electro-polishing or other mechanically smoothing techniques of the subject surfaces before or after plating with the materials, an extremely smooth and slick surface exhibiting a coefficient of sliding friction of less than 0.1 may be created. In this type of coating, micron-sized polytetrafluoroethylene particles are embedded and dispersed (for example, 22–25% by volume) throughout the hard nickel coating. As wear or erosion of the nickel takes place, more polytetrafluoroethylene is exposed. Coating thickness may be, by way of example only, from about 7 microns to about 0.005 inch.

It is further proposed, to resist the sticking of shale to drill bits and features thereof, to treat portions of the bit with coatings of various materials including polytetrafluoroethylene. While it is understood that coatings of many of these materials may be very quickly abraded off of cutting elements, the bottoms of blades and radially oriented surfaces of gage pads, such coatings are expected to remain in other areas, such as fluid courses on the bit face and junk slots, for an extended period of time. Since bit balling in shales has been demonstrated to commence by clogging of the junk slots, it is believed that the coatings will reduce such tendencies. Several coatings offered by SW Impregion of Houston, Tex. may be suitable: Impregion 964, a ceramic-reinforced Teflon® of very high lubricity (slickness) exhibiting medium toughness and adhesion to the bit body; Impregion 872-R, a PPS (polyphenylene sulfide) resin-reinforced Telfon® exhibiting medium high lubricity and medium high toughness and adhesion to the bit body; and CeRam-Kote 54, a flexible ceramic of medium to low lubricity and extremely high toughness and adhesion to the bit body. However, it is believed that an optimum combination of lubricity in combination with longevity on the bit may be achieved with further experimentation. In that vein, it is also believed that application or formation of a porous base coating on the bit or selected areas thereof followed by subsequent impregnation of the base coating pores with Teflon® may achieve the desired combination of lubricity and longevity, and such technique is considered to be within the scope of the present invention.

In addition, superabrasive materials such as diamond, polycrystalline diamond, diamond-like-carbon (DLC), nanocrystalline carbon, amorphous carbon and related vapor-deposited (e.g., plasma vapor deposition or chemical vapor deposition) carbon-based coatings such as carbon nitride and boron nitride can be applied to large surface areas at temperatures (as low as less than 300° F.) below that which would affect the metallurgical integrity of the bit material being coated. The vapor-deposited, carbon-based coatings preferably achieve a hardness of at least 3000 Vickers, provide a sliding coefficient of friction of 0.2 or less, and exhibit a nonwater-wet surface. Ceramic materials, as noted above, may also provide an effective low-adhesion surface to be applied to the surface of the bit. A further advantage of the immediately foregoing superabrasive and ceramic materials is high erosion resistance, which may be used beneficially to retard roller-cone shell erosion.

The inherent properties of these coating or plating materials used to treat the bit surface provide low adhesion and/or abrasion resistant coating to both rotary drag bits and roller-cone bits. However, the low-adhesion characteristics may be further enhanced by chemically treating, polishing, grinding, lapping or otherwise treating the surface of the material applied to the bit, or the surface of the bit body itself, by methods known in the art to create an even smoother, low-adhesion surface. Moreover, the bit surface selected for treatment by application of a different material thereto may first be selectively abraded, etched or otherwise roughened to produce anomalies in the surface for penetration by the different material so as to achieve a better bond therewith. If molds are employed to define the outer surface of a coating of such different material, the mold cavity walls may be finely finished to provide an extremely smooth, exposed coating surface over the bit.

In another more particular aspect of the invention, the surface finish covers at least a portion of the face of a rotary drag bit, that is, the portion or portions of the bit adjacent the cutting elements. Creating a surface low in roughness at this location allows the formation cuttings generated by the cutters to easily flow into the junk slots of the drill bit. Further, the junk slots themselves may also be lined with a smooth surface finish so that the cuttings slide through the junk slots and into the borehole. This structure may be achieved by preforming the lining material into a free standing film that is subsequently attached to the bit body by an epoxy or other methods and/or materials known in the art. These same techniques may be employed on roller-cone bits as well. For example, each roller-cone, the inserts or portions thereof, as well as portions of the bit body such as the throat area between the legs carrying the roller-cones may be treated in a way that the surface finish of the roller-cone creates a slick or antiballing surface.

In another more particular aspect of the invention, the coating or plating material is applied across the various interfaces between the components of the bit to smooth any voids, gaps or other discontinuities therebetween. For example, when the cutters are attached to the face of the bit or inserts are secured in sockets of roller-cones by methods known in the art, gaps, voids or discontinuities may exist between the bit body or cone and the cutters or inserts. By smoothing these discontinuities with an abrasion-resistant filler material such as a urethane, a more uniform, hydronamically smooth transition is formed that reduces the potential for abrasion-or-erosion-induced cutter or insert loss and allows cuttings produced during drilling to easily flow from the cutters over the face of the bit. Complete filling of the discontinuities may not be required. As a result, exterior topographical surfaces of the bit such as the cutters, the face of the bit, roller-cones, inserts and junk slots remain in better condition as drilling proceeds, and stay clear of debris generated during the drilling process. Furthermore, if desired, the exterior areas of the roller-cones between the rows of inserts, or substantially the entire exterior cone surfaces, may be treated by coating or plating in accordance with the present invention.

Generally, a low friction or nonwater-wet surface condition on a bit will assist in the transport of cuttings away from the bit face into the junk slots and into the annulus of the hole between the drill string and the wall. The significant reduction of adhesion results in better cutting transport and less clogging of the cuttings on the bit face resulting in a more efficient cutting action. Moreover, the shear stress or resistance to movement of the bit by the contacted formation is also substantially reduced, promoting a greater rate of penetration of the bit body into the formation. Further, for a given depth of cut and rate of penetration the torque required to rotate the bit may be substantially reduced.

The present invention overcomes disadvantages found in the art associated with drilling formations which fail plastically or which behave in a ductile manner. By providing a smooth surface condition along an exposed surface of the bit, cuttings tend to flow over the bit without adhering to that surface. Moreover, the potential chemical bonding of the formation cuttings to that surface of the bit is significantly reduced by selection of suitable materials.

In FIG. 1 of the drawings, a rotary drag-type bit 10 in accordance with the present invention is shown. The bit 10 has a face 12 including waterways 13 at a distal end 14 and a connector 16 at a proximal end 18. A plurality of cutting elements 20 are attached to the face 12 oriented to cut a subterranean formation during rotation of the bit 10. The bit 10 also has a plurality of junk slots 22 on the bit face 12 so that drilling fluid and formation cuttings may flow up through the junk slots 22 and into the borehole annulus above the bit (not shown). Generally, the junk slots 22 are defined by a recessed portion 23 and a raised portion or gage pad 25 that may optionally contain one or more cutting elements 20.

Figure 2:
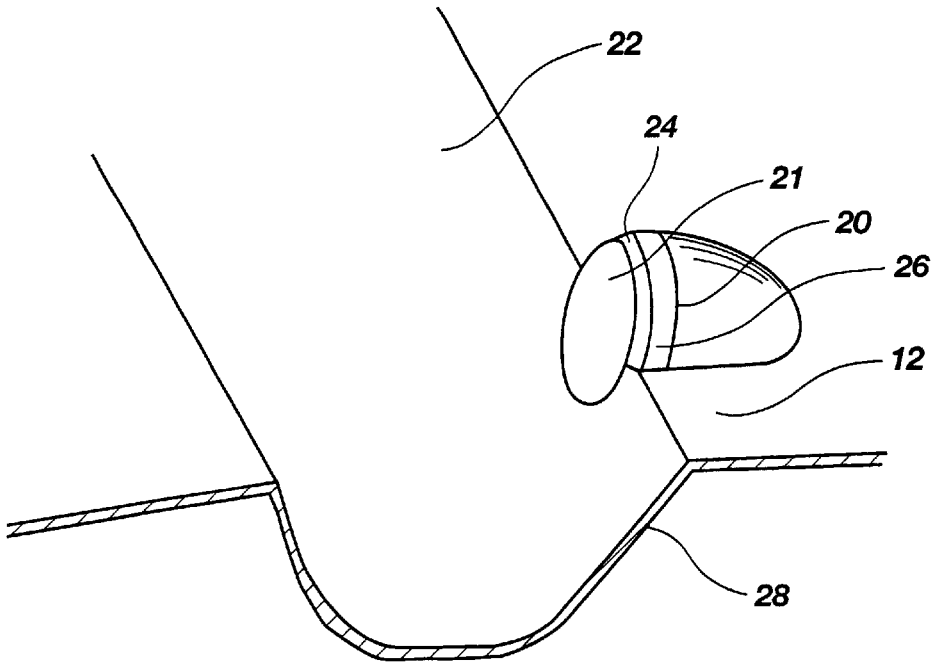
FIG. 2 is a perspective view of a cutting element attached to a rotary drag bit with a sectional view of the face of the bit in accordance with the present invention.

Referring now to FIG. 2, a perspective view of a cutting element 20 with a sectional view of the bit face 12 of the embodiment shown in FIG. 1. The cutting element 20 has a cutting face 21 generally comprised of a diamond table 24 bonded to and supported by a substrate 26. The cutting element 20 is then attached to the bit face 12 by methods known in the art (e.g., brazing) so that approximately one-half of the cutting face 21 is exposed above the bit face 12. Typically, the cutting elements are located adjacent a waterway 13 on the bit face or junk slot 22 so that formation chips generated during the drilling process may flow up through the recessed portion 23 and into the borehole (not shown).

Figure 3:
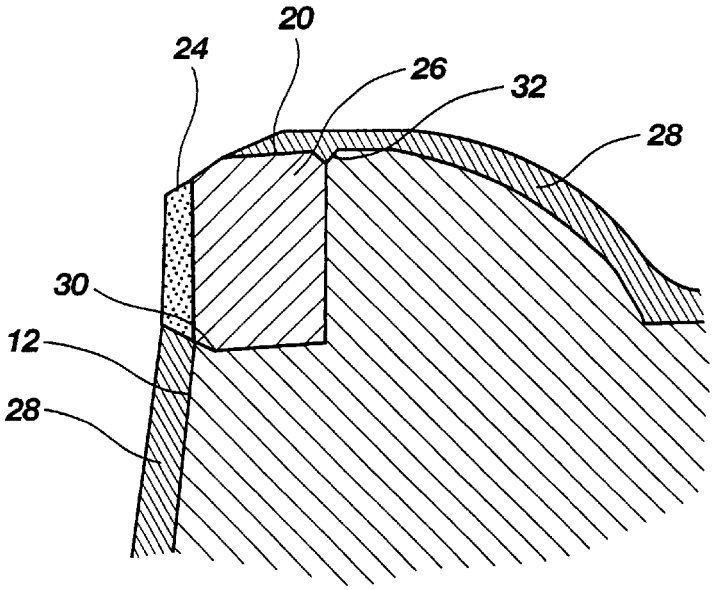
FIG. 3 is a side sectional view of the embodiment shown in FIG. 3.

As can be seen in FIGS. 2 and 3, a coating or plating material 28 covers at least a ortion of the face 12 to provide a substantially voidless and vugless surface thereon. Multiple layers of the same or different may be employed. Moreover, coating or plating material 28 may cover a portion of the cutting element 20 to create a continuous or seamless transition between the cutting element 20 and the face 12. More particularly as shown in FIG. 3, the coating or plating material 28 may also cover or create a more uniform transition at the interfaces 30 and 32 or any other location where there may be a void or gap. The coating or plating material is not required to completely fill the voids or gaps, but only to provide a continuous surface thereacross.

Figure 4:
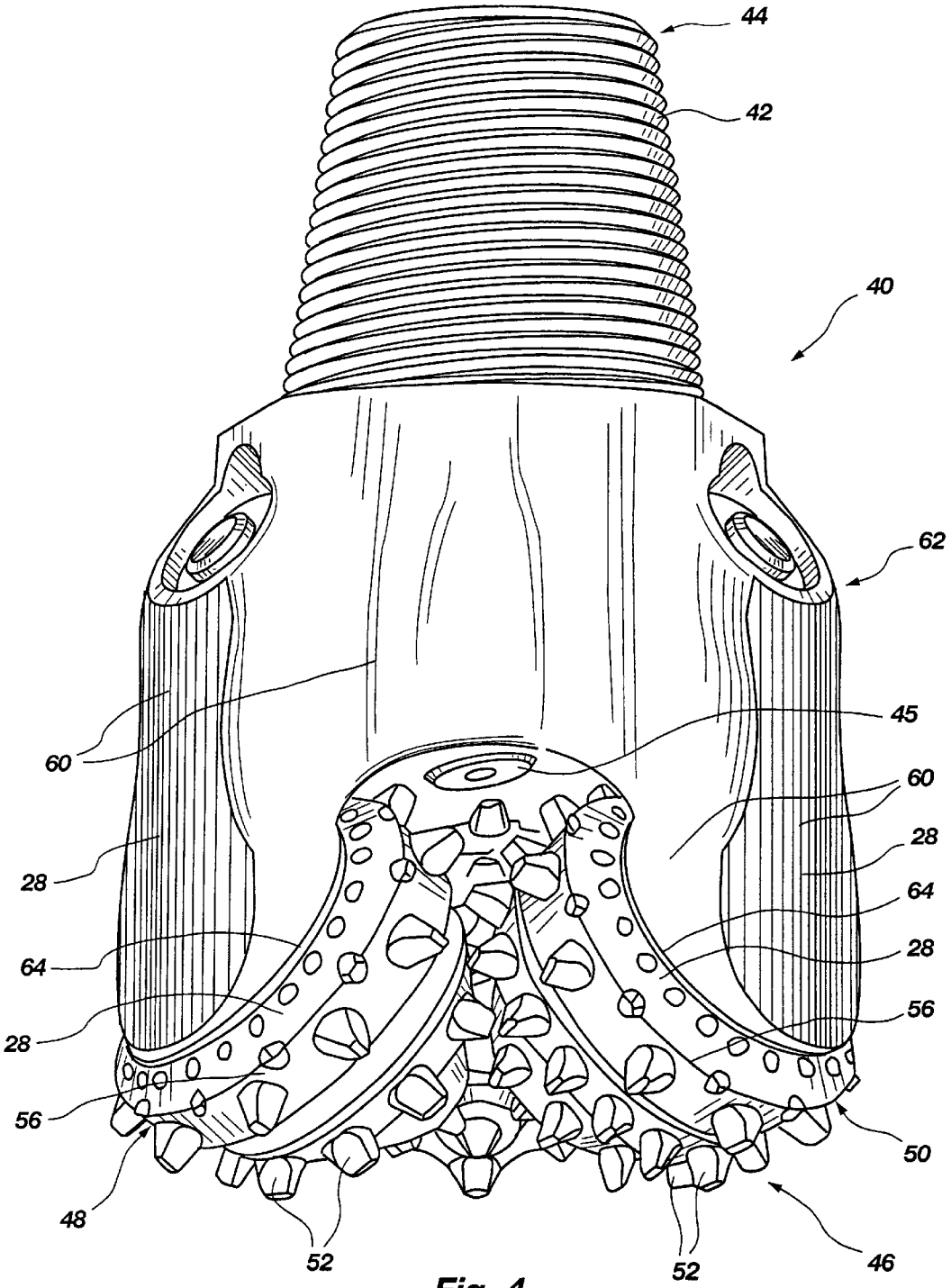
FIG. 4 is a side elevational view of a roller-cone bit in accordance with the present invention.

Referring now to FIG. 4, a side elevation of a roller-cone bit 40 in accordance with the present invention is shown. The bit 40 has a threaded portion 42 at a proximal end 44 for connection to a drill string (not shown). At a distal end 46 of the bit 40, two of the roller-cones 48 and 50 are shown. The roller-cones 48 and 50 are each rotatably disposed over a bearing shaft 47 and secured thereto by ball bearings 70 disposed in an annular recess 71 extending about bearing shaft 47(see FIG. 5). The roller-cones 48 and 50 have a plurality of teeth or inserts 52 extending from outer surfaces 56. An internal plenum extends from the proximal end 44 into the roller-cone bit 40 to a channel extending to a nozzle orifice in which nozzle 45 is secured. Drilling fluid is circulated from the drill string (not shown) into the plenum, through the channel and out through nozzle 45 secured in the nozzle port. The drilling fluid is thus directed to the teeth 52 of the roller-cones 48 and 50. The teeth 52 and the outer surfaces 56 of the roller-cone 48 and 50 are covered by a coating or plating material 28. The coating or plating material 28 provides a smooth, continuous surface over the teeth 52 and the respective outer surfaces 56. Moreover, the coating or plating material 28 creates a more uniform transition surface across any voids, gaps or other irregularities or discontinuities that may exist on the surface of the roller-cone 48 or between the teeth 52 and the outer surfaces 56. As noted previously, the coating or plating material 28 need not completely fill gaps or voids at the interfaces between components. Further, the coating or plating material 28 may be used to provide closer tolerances at the gaps 64 between the bit body 62 and the roller-cones 48 and 50. The surface 60 of the bit body 62 may also have the coating or plating material 28 covering at least a portion thereof As a result, formation cuttings generated during the drilling process are less likely to adhere to the outer surfaces 56 of the cones 48 and 50, the teeth 52, or the surface 60 or the bit body 62.

Figure 5:
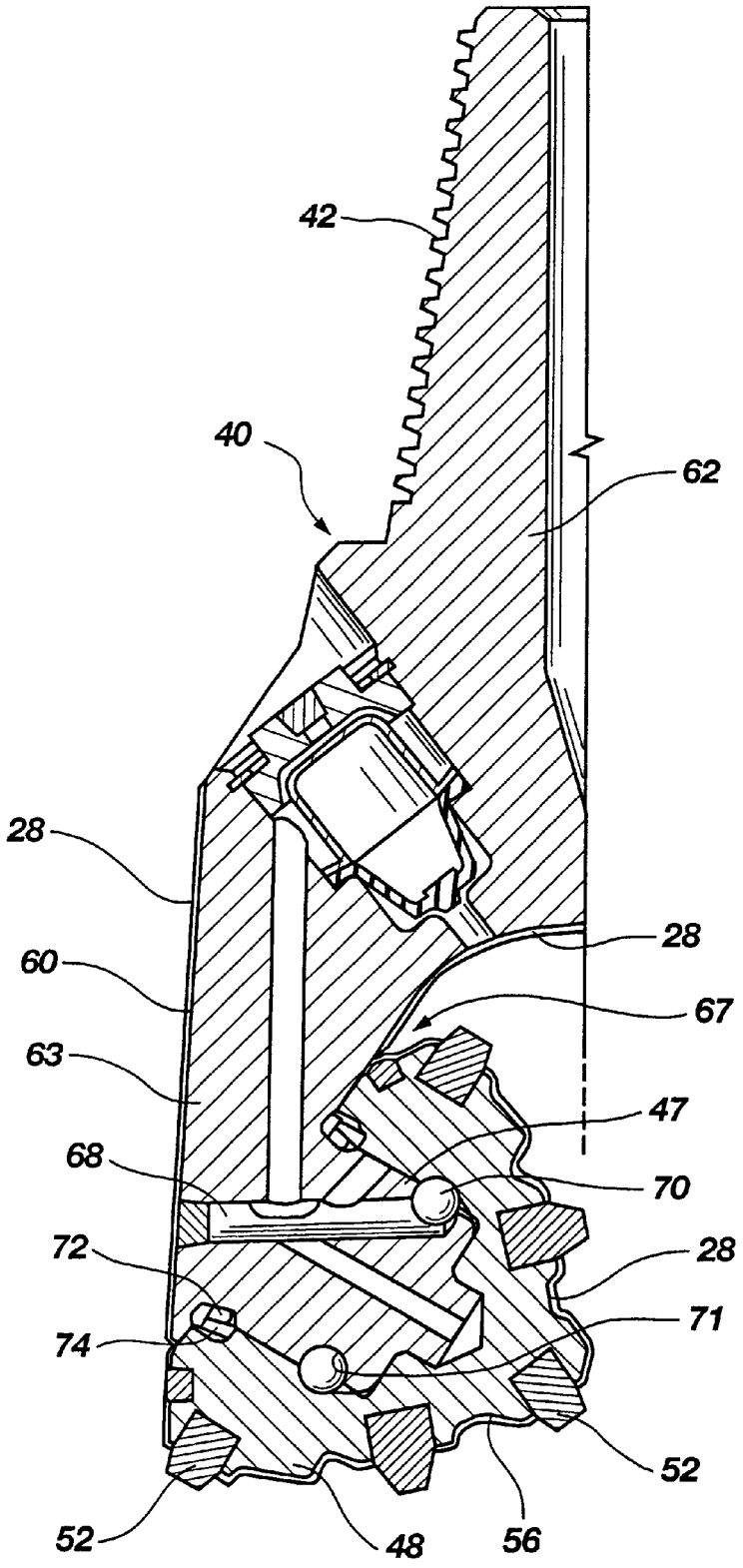
FIG. 5 is a side sectional view of a one cone of a roller-cone bit and an associated bit body portion including a cantilevered journal bearing shaft, in accordance with the present invention.

FIG. 5 depicts a single roller-cone 48 in cross section mounted to cantilevered, substantially cylindrical bearing shaft 47 extending generally radially inwardly and downwardly oriented (presuming the bit is drilling vertically downward) from leg 63 of bit body 62. Ball plug 68 is shown retaining a plurality of ball bearings 70 disposed in an annular recess 71 extending about bearing shaft 47, ball bearings 70 rotatably securing roller-cone 48 on bearing shaft 47. The roller-cone 48 is shown having a plurality of cutting elements, inserts or teeth 52 inserted in apertures extending from outer surface 56 into roller-cone 48, although such cutting elements or teeth 52 may be formed integrally with the roller-cone 48 (i.e., a mill tooth bit) as known in the art. The plating or coating material 28 is shown to cover at least a portion of the outer surface 56 of the roller-cone 48. More particularly, the plating or coating material 28 extends over substantially the entire outer surface 56 of roller-cone 48 and at least partially filling any voids, gaps or recesses between teeth 52 and the outer surface 56. It should also be noted that a nonstick coating in the area 67 where the roller-cone 48 meets leg 63 may be beneficial to prevent sticking of any clay component in the drilling mud in this area, since the clay causes other particles to adhere. Mechanical compaction of particles is also alleviated by a low-adhesion coating in this area by avoidance of particulate accumulation in the relatively confined spaces between the roller-cone and the bit body which otherwise might effect a mechanical interference between the bit surfaces and compacted formation material. As used herein, the term "low adhesion" encompasses a reduced tendency of substances (such as, for example, formation material) in contact with a coating or other surface treatment on a bit component to adhere thereto.

A major contributor to premature failure of rock bit (tri-cone bit) bearing seals is adhesion and accumulation of suspended drilling fluid solids on component surfaces adjacent the seal. Packing of drill solids has been shown to increase the wear rate on metal face seals and to increase the occurrence of rotation or slippage of resilient O-ring energizer for the metal face seal. In O-ring sealed bits, accumulation of drill solids under the seal results in accelerated wear on the O-ring surface above the head seal boss. Thus, it may also be beneficial to treat surfaces near a bearing seal which are in contact with drilling fluid. The treated area will not be "wet" by the drilling fluid and thus any accumulation of drilling fluid solids around the seal will be retarded. A preferred surface treatment may be a material such as, by way of example only, polytetrafluoroethylene (PTFE), fluorinated ethylene propylene (FEP), or perfluoroalkoxy (PFA) in a hard, porous, metallic or ceramic matrix. Such a material would be nonwater-wettable, have low surface free energy, and exhibit low adhesion of the formation material. Of course, dimensions and tolerances of adjacent components may be changed to accommodate the surface treatments and still provide proper operation of the bit.

It should be noted that a surface treatment in accordance with the present invention may be applied directly, for example, to a surface of a drill bit component such as a roller-cone or leg of a bit body. Alternatively, and in some instances preferably, the surface treatment may be provided on the surface of a discrete, supplemental insert or itself comprise an insert which is then secured to the drill bit component by techniques well known in the art including, for example, shrink fitting, press fitting, brazing, adhesive bonding, etc., the preferred technique being a function of the shape and material of the insert and the location of placement on the drill bit component.

FIGS. 5A–5E provide more specific guidance as to those areas of the bit body which may benefit from treatment according to the present invention in the context of bearing seal protection using a metal face seal. O-ring sealed bits as illustrated in FIGS. 5F and 5G may, of course, benefit from similar treatment to alleviate solids accumulation and consequent seal wear.

Features in FIGS. 5A–5E already identified by reference numerals in FIG. 5 are designated by the same reference numerals for clarity. FIG. 5A depicts a single roller-cone 48 in cross section mounted to cantilevered bearing shaft 47 mounted to leg 63 of bit body 62. The roller-cone 48 has a plurality of cutting elements, inserts or teeth 52 inserted in apertures extending from outer surface 56 into roller-cone 48. Ball plug 68 is shown retaining a plurality of ball bearings 70 disposed in an annular recess 71 about bearing shaft 47, bearings 70 rotatably securing roller-cone 48 on bearing shaft 47. Rigid shaft seal ring 72 is disposed about bearing shaft 47 inwardly (toward leg 63) of tubular bushing insert 73 which is interference-fit into roller-cone 48, and resilient energizer ring 74 is compressed between shaft seal ring 72 and the radially inner surface of shaft seal groove 76. Backup ring 78 may optionally be employed at the proximal (leg) end of shaft seal groove 76, as depicted in FIG. 5B. A resiliently-energized metal-to-metal face seal is thus provided at 75 between the radially extending surface of shaft seal ring 72 and the radially extending surface of bushing insert 73. Plating or coating material 28 comprising a surface treatment according to the present invention is shown to cover at least a portion of the outer surface of leg 63 proximate the base of bearing shaft 47. More particularly, if no backup ring 78 is employed (see FIG. 5C), the plating or coating material 28 extends substantially about the base of bearing shaft 47 and upwardly onto leg 63, as shown in FIGS. 5D and 5E. If a backup ring 78 is utilized, then the contact area 80 at the proximal end of shaft seal groove 76 comprising a backup ring groove extending into leg 63 remains untreated, but the leg area radially outboard of backup ring 78 and an extended area thereabove is preferably treated. Further, the plating or coating material 28 may be applied to the radially outer surface 82 of shaft seal ring 72, and to the radially inner surface 84 of roller-cone 48 surrounding shaft seal ring 72. As shown in FIGS. 5A through 5E, low-adhesion (and preferably low surface free energy, nonwater-wettable) surface treatments according to the invention provide an environment which will retard accumulation of drill solids in these confined areas and also thereby avoid an accumulation thereof sufficient to avoid mechanical compaction of particles within the confined space defining the bearing seal area at the base of bearing shaft 47. As noted above, surface treatments according to the invention may not only be provided directly on the surfaces of, for example, a leg 63 or a bearing shaft 47, but also on other components as, for example, shaft seal ring 72 (see FIGS. 5B and 5C). Further, surface treatments according to the invention may themselves be embodied as inserts which are secured to other components. See, for example, FIG. 5C wherein exemplary insert locations $I_i$ and $I_2$ are depicted in broken lines.

Figure 5F:
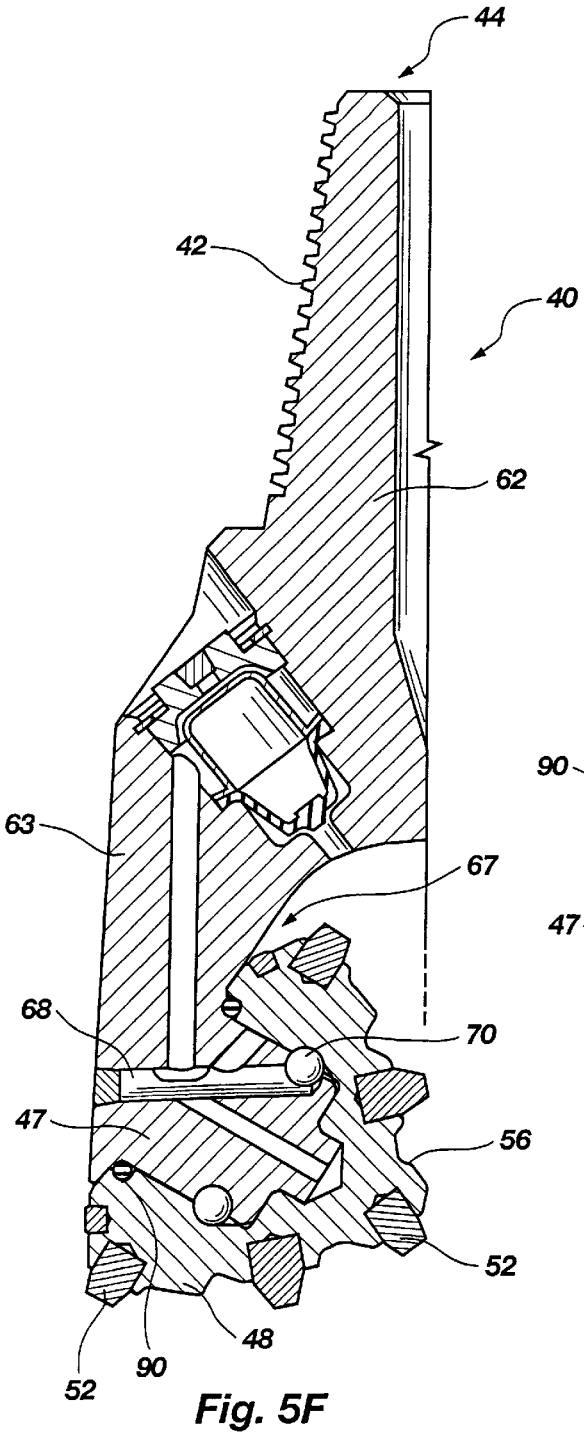
FIG. 5F comprises a side sectional view similar to FIGS. 5 and 5A of one cone and an associated bit body portion of an O-ring sealed roller-cone bit including a cantilevered bearing shaft and FIG. 5G is an enlargement of a portion of FIG. 5F depicting locations of surface treatments adjacent the O-ring.
Figure 5G:
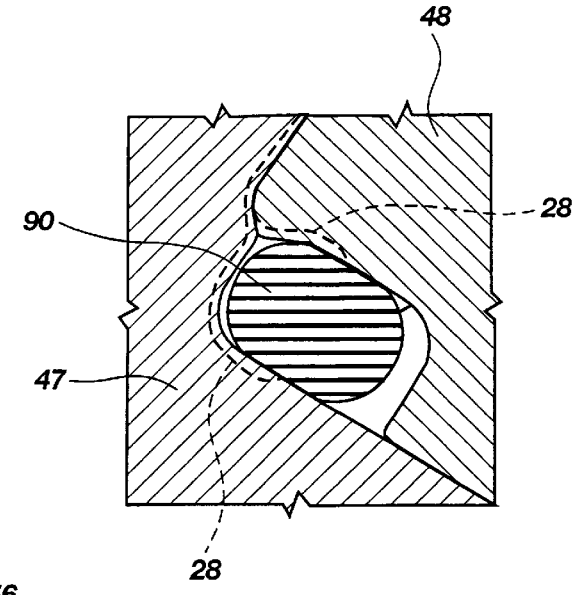

Referring to FIGS. 5F and 5G, portions of an exemplary O-ring sealed roller-cone bit 40 is illustrated. Reference numerals used to denote similar features with respect to FIGS. 4 and 5 through 5E are the same in FIG. 5F. Potentially beneficial areas of coating or plating material 28 nonwettable by drilling fluid employed proximate elastomeric seal in the form of O-ring 90 to retard accumulation of drilling fluid solids and consequent O-ring surface wear are bordered in broken lines in FIG. 5G, which comprises an enlargement of the O-ring seal area between bearing shaft 47 and roller-cone 48 shown in FIG. 5F. Of course, such surface treatments may, as previously noted, comprise surface treatments of strategically positioned inserts, or comprise inserts themselves.

While the surface treatments of the present invention in the context of roller-cone bits have been discussed and illustrated with respect to journal bearing bits, it will, of course, be understood and appreciated by those of ordinary skill in the art that such surface treatments are equally applicable to roller bearing bits, which typically comprise larger diameter bits exhibiting relatively higher speeds of cone rotation. In contrast, journal bearing bits are typically smaller diameter bits exhibiting relatively higher unit loads by the roller-cones on the bearing shafts.

Figure 6A:
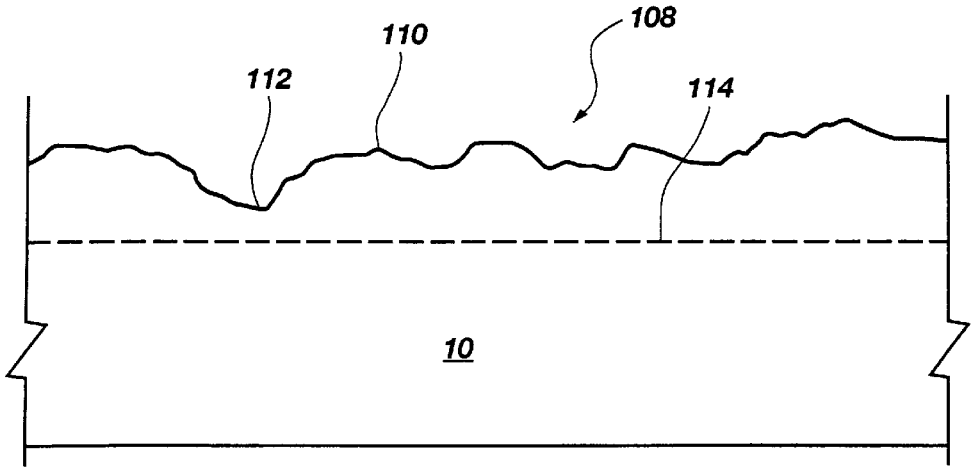
FIG. 6A is an exemplary rendering of a side sectional elevation illustrating the topography of the surface of a drill bit that has been cast and sandblasted in accordance with the present invention.
Figure 6B:
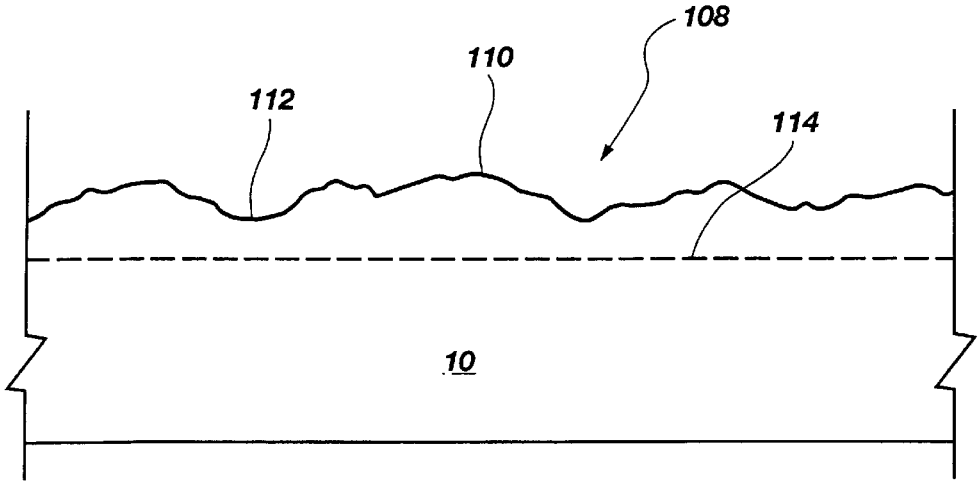
FIG. 6B is an exemplary rendering of a side sectional elevation illustrating the topography of the surface of a drill bit that has been cast in accordance with the present invention.
Figure 6C:
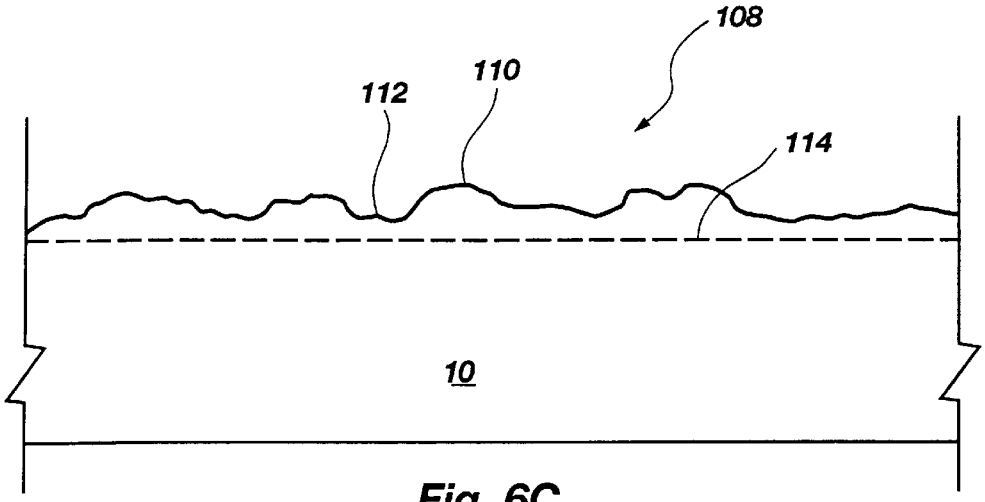
FIG. 6C is an exemplary rendering of a side sectional elevation illustrating the topography of the surface of a drill bit that has been ground in accordance with the present invention.
Figure 6D:
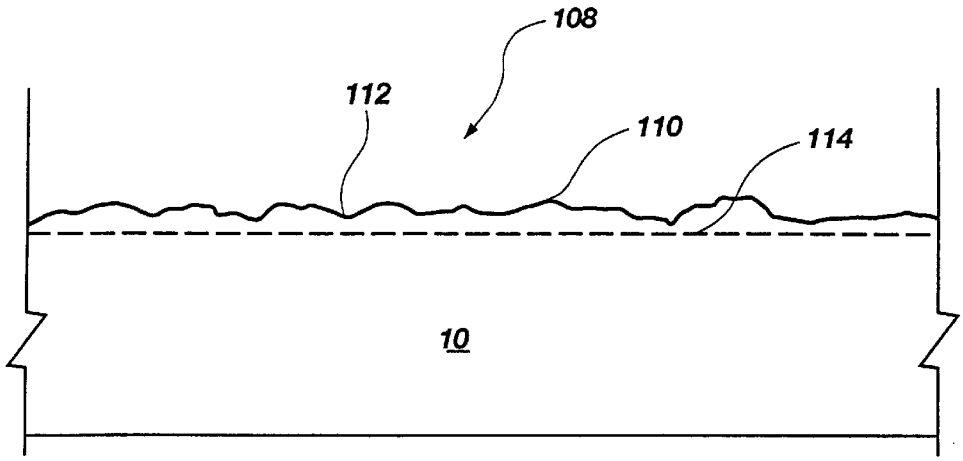
FIG. 6D is an exemplary rendering of a side sectional elevation illustrating the topography of the surface of a drill bit that has been coated or plated in accordance with the present invention.
Figure 6E:
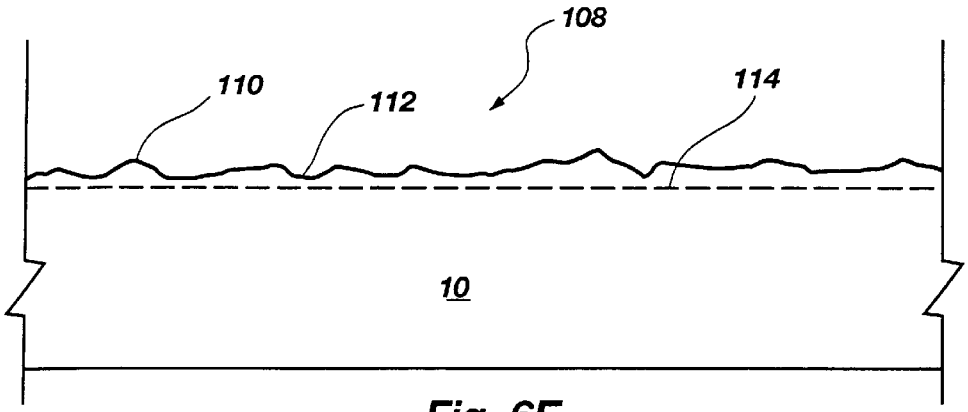
FIG. 6E is an exemplary rendering of a side sectional elevation illustrating the topography of the surface of a drill bit that has been polished in accordance with the present invention.
Figure 6F:
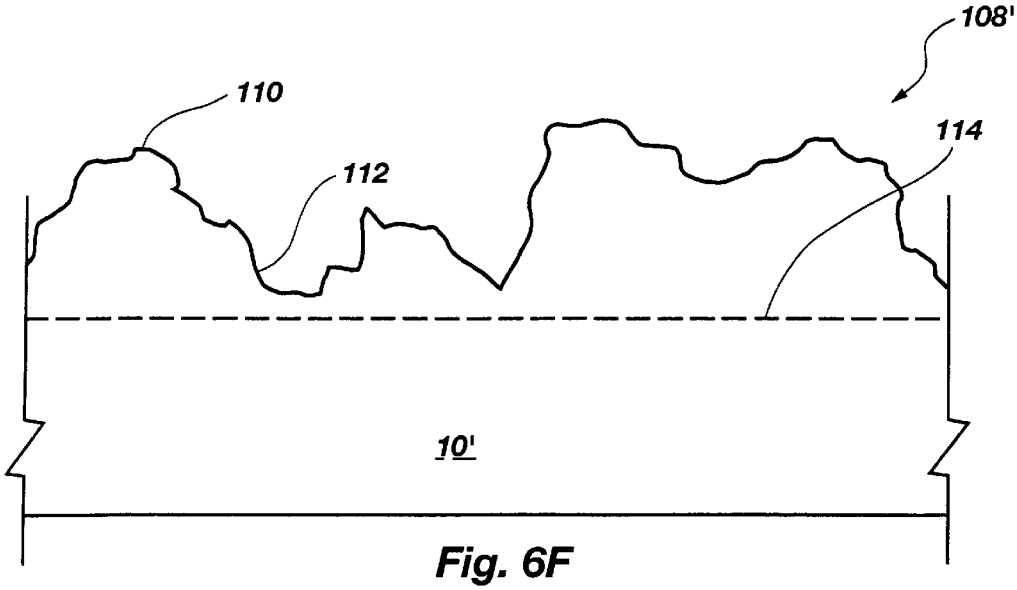
Fig. 6F (PRIOR ART)
FIG. 6F is an exemplary rendering of a side sectional elevation illustrating the topography of the surface of a prior art drill bit.

Referring to FIGS. 6A–6F of the drawings, the difference in surface topography between surfaces 108 of a drill bit 10 including a surface treatment in accordance with the present invention and the surface 108' of a prior art bit 10' will be readily appreciated. Each figure depicts an exemplary rendering of a resultant surface finish obtained by different processes used during manufacturing and not tracings of actual photomicrographs. As can be seen in FIGS. 6A–6F the surfaces are shown to contain microscopic "peaks" 110 and "valleys" 112 in the surface 108. Such minute variations in the surface 108 may always be present. However, by reducing the overall height of the peaks 110 in relation to the valleys 112, a relatively low surface finish roughness can be achieved. A marked difference can be seen between the surface finishes depicted in FIGS. 6A–6E and the prior art surface finish shown in FIG. 6F. Broken line 114 provides a reference baseline within each figure from which to view the relative surface roughnesses of the surface 108. Referring to FIG. 6A, a representation of a bit surface 108 is shown that has been cast, coated or otherwise formed in accordance with the present invention and then mechanically worked to reduce the surface finish roughness (RMS) to $32\mu$ in or less. By utilizing various techniques heretofore mentioned and known in the art, a smooth surface having a relatively low surface roughness may be achieved. FIG. 6B depicts a representation of a bit surface 108 that has been initially formed to a relatively smooth surface finish and FIG. 6C is a representation of a bit surface 108 that has been formed and subsequently ground to a low surface finish roughness. FIG. 6D is a representation of a bit surface 108 that has been plated or coated and FIG. 6E is a representation of a bit surface 108 that has been polished. By controlling desired manufacturing tolerances, selecting suitable treatment materials as well as processes for application and finishing thereof, the surfaces 108 described herein may be cost-effectively achieved.

Figure 7:
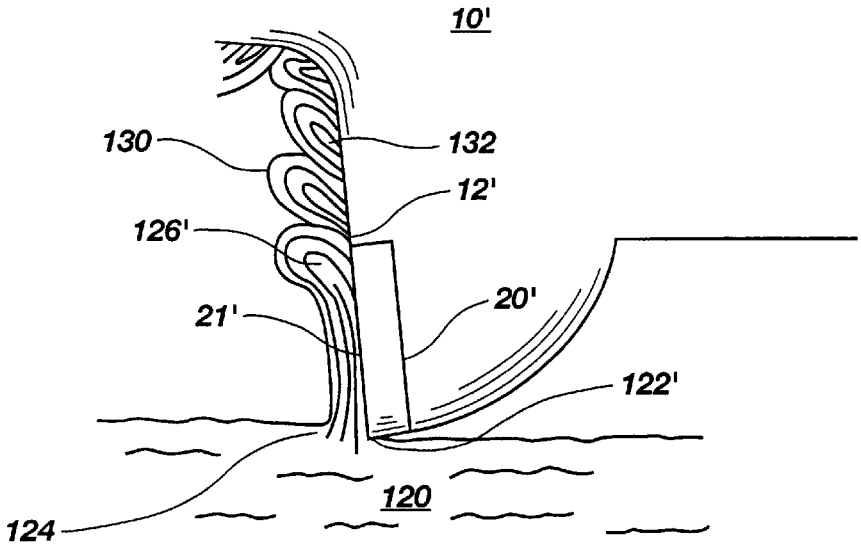
Fig. 7 (PRIOR ART)
FIG. 7 is a side elevation of a prior art cutting element and adjacent bit face as it engages and cuts a subterranean formation, depicting the manner in which formation chips cut from the formation can buildup on the face of the bit and impede the cutting process and removal of chips from the bit.

Referring now to FIG. 7 of the drawings, a cutting element 20' is shown mounted on the face 12' of a prior art rotary drag bit 10' and oriented for drilling in a subterranean formation 120. Formation 120, which by way of example may be an aforementioned shale, is being engaged by the cutting element 20', which may comprise a superabrasive cutting element having a polished cutting face in accordance with the teachings of previously-referenced U.S. Pat. Nos. 5,447,208 and 5,653,300 to Lund et al. The cutting edge 122' engages the pristine or completely uncut portion 124 of formation 120. As the formation chip 126' moves across the cutting face 21' and contacts the face 12', a large buildup of formation cuttings 130 forms at the interface 30' between the cutting element 20' and the face 12'. Ultimately, the buildup of formation cuttings 130 will backup onto and extend over the cutting face 21', under the cutting edge 122' and impede the cutting efficiency of the cutting element 20'. The irregular formation chip 132 will actually be more or less extruded from the massive buildup of formation chips riding against the face 21' of the cutting element 20', and not cut directly from the formation 120. As a result, failure of the formation 120 will eventually occur ahead of the cutting element 20' and not at the cutting edge thereof. It is thus readily apparent that this undesirable buildup of formation material ahead of the cutting element 20' will impair the cutting action of the cutting element 20'. Once a buildup of formation cuttings 130 occurs, the normal force, or in real terms, the weight on bit, which needs to be applied to the bit to effect a desired depth of cut and rate of penetration through the formation 120 must be made undesirably and, in some cases unreasonably, high. In a similar manner, the tangential forces or the torque required to rotate the bit at the bottom of the borehole in such a situation is again undesirably increased, as the cutting element 20' merely moves the formation chip 126' out of the way by brute force, being unassisted by the relatively sharp cutting edge 122' of the cutting element 20'. Stated another way, the required normal and tangential forces are both increased due to the large bearing area provided by the buildup of formation cuttings 130 at the cutting edge 122' of the cutting element 20'. The net result is an extremely inefficient rock cutting removal mode, which in some circumstances and in certain formations may actually cause a cessation of drilling.

Figure 8:
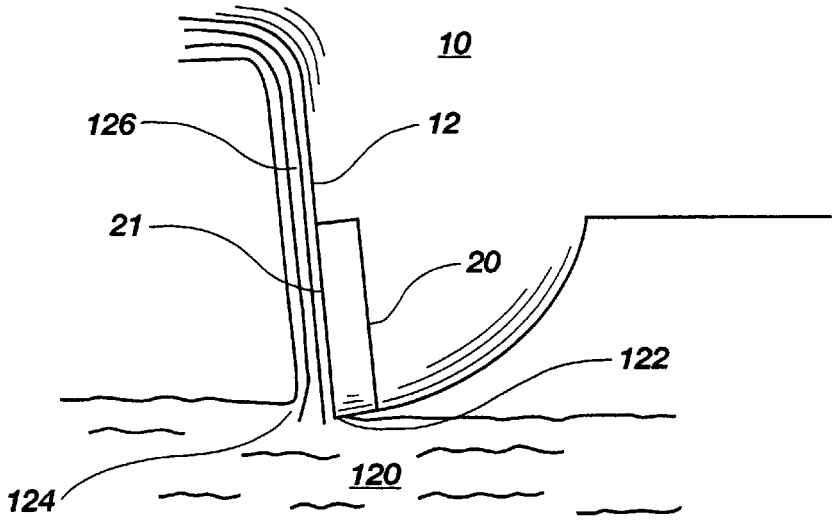
FIG. 8 is a side elevation of a cutting element and adjacent bit face according to the present invention having a relatively smooth surface finish, depicting the continuous and uniform manner in which a formation chip is cut and removed from the formation without buildup on the bit face.

Referring now to FIG. 8 of the drawings, a cutting element 20 similar to cutting element 20' is depicted mounted on the face 12 of bit 10 according to the invention in the process of engaging and cutting the same subterranean formation 120. The substantial difference between the two cutting elements is that the bit face 12 has been physically modified, as by coating, plating, and/or polishing or other means known in the art to a relatively smooth, low-friction and low-adhesion surface finish adjacent the low-friction finish of superabrasive cutting face 21 as taught by Lund et al. As illustrated, it will readily be seen that the cutting edge 122 of cutting element 20 is fully engaged with the pristine or previously uncut and undisturbed portion 124 of subterranean formation 120. Thus, cutting edge 122 is able to cut or shear a formation chip 126 from the formation 120 in an unimpeded manner. As shown, formation chip 126 of substantially uniform thickness moves relatively freely from the point of contact or line of contact from cutting edge 122 of cutting face 21 upwardly along the cutting face 21, over the bit face 12 through a fluid course leading to a junk slot 22 (see FIG. 1). The relatively smooth surface finish provided on face 12 continuing that of cutting face 21 lowers the overall stresses applied to the rock in the cutting area and permits the chip 126 to ride smoothly away from cutting element 20 due to reduced sliding friction in an unimpeded manner across the face 12.

In addition to the foregoing alterations in bit component surface finishes, it is also contemplated that the surface finishes of drag bit cutters and roller-cone bit inserts may be significantly enhanced (smoothed) by a variety of other techniques. For example, a thin, silicon nitride coating may be applied to a diamond or cubic boron nitride cutting face and then polished. Carbide compacts (inserts) used for rock drilling on roller-cone bits may be finished by EDM (electro-discharge machining) with reverse image tooling of the shape to reduce microanomalies in the surface finish caused by the pressing and sintering operation used to form the inserts. If required, the surface could be polished with a diamond paste. Subsequently, a thin diamond film could be deposited by chemical vapor deposition techniques to bond to the surface of the carbide compact. In lieu of diamond film deposition, the electro-discharge machined compact might be diamond lapped or finished with a diamond superfinishing stone. A dual property cemented tungsten carbide or other carbide material with low (3%–16%) by weight cobalt content may be well suited for such applications. A dual property carbide is a multilayered carbide material that may exhibit multiple physical or metallurgical properties in its completed form. For example, cobalt content may vary between the outer (surface) region and an inner region of the carbide structure. If the outer region has a lower cobalt content, it will exhibit higher wear resistance and thermal fatigue resistance than the inner region. Such dual-grade carbides may be formed by pressing a carbon deficient carbide with an initial starting weight percent, for example 6%, of Co to a desired shape. Then, during sintering in a controlled methane gas atmosphere, the outer regions of the structure lose several weight percent of Co to the inner region of the eta phase (carbon-deficient phase of the sintered carbide). Thus, the outer portion of the structure may retain as little as three weight percent of Co, while the inner region may exhibit up to nine weight percent Co with eta phase. Alternatively, such a structure might be formed by coating a substrate of a selected grade with a carbide slurry of a different grade prior to sintering them together as one. Further, such a structure might be effected by pressing together two different carbides using the ROCTEC process offered by Dow Chemical Company.

While the present invention has been described in terms of certain preferred embodiments, it is not so limited, and those of ordinary skill in the art will readily recognize and appreciate that many additions, deletions and modifications to the embodiments described herein may be made without departing from the scope of the invention as hereinafter claimed.

What is claimed is:

1. A drill bit for drilling subterranean formations comprising:

a body assembly including an exposed surface thereon other than a surface configured for cutting a subterranean formation being drilled for disposition proximate thereto during drilling; and at least one surface treatment including a material different than a material of the exposed surface over at least a portion of the exposed surface providing reduced adhesion characteristics for subterranean formation material to said at least a portion of the exposed surface.

2. The drill bit of claim 1, wherein the at least one surface treatment exhibits a surface finish roughness of about 32 $\mu$ in. or less, RMS.

3. The drill bit of claim 1, wherein the at least one surface treatment exhibits a sliding coefficient of friction of about 0.2 or less.

4. The drill bit of claim 1, wherein the at least one surface treatment comprises a vapor-deposited, carbon-based coating exhibiting a hardness of at least about 3000 Vickers.

5. The drill bit of claim 1, wherein the at least one surface treatment exhibits a nonwater-wettable finish.

6. The drill bit of claim 1, wherein the at least one surface treatment exhibits a surface with lower surface free energy and reduced wettability by at least one fluid in comparison to an untreated portion of the exposed surface.

7. The drill bit of claim 1, wherein the at least one surface treatment exhibits a nonwet or low-wettability finish in aqueous fluids.

8. The drill bit of claim 1, wherein the at least one surface treatment is comprised at least in part of a nonmetallic material.

9. The drill bit of claim 8, wherein the nonmetallic material is selected from the group comprising: polymers, PTFE, FEP, PFA, ceramics and plastics.

10. The drill bit of claim 9, wherein the nonmetallic material is at least partially filled with a metallic material.

11. The drill bit of claim 9, wherein the nonmetallic material at least partially fills a porous material selected from the group comprising metals, alloys, cermets and ceramics.

12. The drill bit of claim 8, wherein the nonmetallic material is selected from the group comprising: polymers, PTFE, FEP, PFA and plastics.

13. The drill bit of claim 12, wherein the nonmetallic material is at least partially filled with a metallic material.

14. The drill bit of claim 12, wherein the nonmetallic material at least partially fills a porous material selected from the group comprising metals, alloys, cermets and ceramics.

15. The drill bit of claim 1, wherein the at least one surface treatment comprises at least one layer of a nonmetallic, hard facing material.

16. The drill bit of claim 15, wherein the nonmetallic, hard facing material is selected from the group comprising diamond film, monocrystalline diamond, polycrystalline diamond, diamond-like carbon, nanocrystalline carbon, vapor-deposited carbon, cubic boron nitride and silicon nitride.

17. The drill bit of claim 1, wherein the at least one surface treatment includes at least one layer of metallic material.

18. The drill bit of claim 17, wherein the metallic material is selected from the group comprising nickel, chromium, copper, magnesium, cobalt, precious metals, noble metals, and combinations and alloys of each of the foregoing.

19. The drill bit of claim 1, wherein the drill bit comprises a rotary drag bit having a distal end including a face and at least one cutting element attached to the face, the at least one cutting element defining a cutting face.

20. The drill bit of claim 19, wherein the at least one surface treatment extends to at least a portion of a periphery of the cutting face.

21. The drill bit of claim 19, wherein the at least one surface treatment extends over at least a portion of the at least one cutting element.

22. The drill bit of claim 19, further comprising an interface between the face and at least a portion of the at least one cutting element, and wherein the at least one surface treatment bridges at least a portion of the interface to smooth a transition between the face and the at least a portion of the at least one cutting element.

23. The drill bit of claim 1, wherein the body assembly includes at least one leg carrying a roller-cone rotatably attached thereto, and at least one cutting structure carried by the roller-cone.

24. The drill bit of claim 23, wherein the at least one surface treatment extends over at least a portion of an exterior surface of the roller-cone and contacts at least a portion of the at least one cutting structure.

25. The drill bit of claim 23, wherein the at least one surface treatment extends over at least a portion of the at least one leg.

26. The drill bit of claim 23, wherein the at least one surface treatment provides a substantially seamless transition between the at least one cutting structure and an adjacent portion of the roller-cone.

27. The drill bit of claim 23, wherein the at least one surface treatment extends substantially continuously in a substantially uninterrupted manner over an exterior surface of the roller-cone.

28. The drill bit of claim 23, wherein the at least one surface treatment is located on at least one of a surface of the at least one leg adjacent the roller-cone and at least a portion of the roller-cone proximate the at least one leg.

29. A rotary drill bit for drilling subterranean formations comprising:

a body including at least one leg;

a cantilevered bearing shaft defining a longitudinal axis and including a base secured to the at least one leg and a substantially cylindrical surface extending from the base along the longitudinal axis;

a roller-cone disposed about the bearing shaft for rotation about the longitudinal axis, the roller-cone including a first end extending beyond the bearing shaft and a second end located proximate the at least one leg;

at least one substantially annular seal element disposed about the bearing shaft proximate the base thereof; and at least one surface treatment exhibiting reduced adhesion characteristics for subterranean formation material, the at least one surface treatment being disposed proximate the bearing shaft base in association with at least one of at least a portion of the at least one leg and at least a portion of the roller-cone.

30. The rotary drill bit of claim 29, wherein the at least one surface treatment is configured as at least an annular area on the at least one leg substantially surrounding the bearing shaft base.

31. The rotary drill bit of claim 29, wherein the at least one surface treatment further extends upwardly on the at least one leg, as the bit is oriented for drilling, away from the bearing shaft for a distance greater than a diameter of the roller-cone at the second end thereof.

32. The rotary drill bit of claim 29, further including an annular shaft seal groove formed about the base of the bearing shaft, and wherein the at least one surface treatment is disposed at least partially adjacent the shaft seal groove.

33. The rotary drill bit of claim 29, wherein the at least one surface treatment is carried by the roller-cone and disposed proximate the second end thereof.

34. The rotary drill bit of claim 33, wherein the at least one surface treatment proximate the second end of the roller-cone comprises a substantially annular surface facing the bearing shaft.

35. The rotary drill bit of claim 29, further including an annular shaft seal groove formed about the base of the bearing shaft, a resilient energizer ring at least partially received in the shaft seal groove and a shaft seal ring disposed about the resilient energizer ring, the shaft seal ring including an outer circumferential surface facing the roller-cone and carrying the at least one surface treatment thereon.

36. The rotary drill bit of claim 29, further including an annular backup ring groove formed in the at least one leg proximate the base of the bearing shaft, and a backup ring at least partially received in the annular backup ring groove, wherein the at least one surface treatment is carried on the at least one leg radially outwardly of the backup ring and on the same side of the at least one leg thereas.

37. The rotary drill bit of claim 29, wherein the at least one surface treatment exhibits a surface finish roughness of about 32 $\mu$ in. or less, RMS.

38. The rotary drill bit of claim 29, wherein the at least one surface treatment exhibits a sliding coefficient of friction of about 0.2 or less.

39. The rotary drill bit of claim 29, wherein the at least one surface treatment comprises a vapor-deposited, carbon-based coating exhibiting a hardness of at least about 3000 Vickers.

40. The rotary drill bit of claim 29, wherein the at least one surface treatment exhibits a nonwater-wettable finish.

41. The rotary drill bit of claim 29, wherein the at least one surface treatment exhibits a surface with lower surface free energy and reduced wettability by at least one fluid in comparison to an adjacent, untreated surface.

42. The rotary drill bit of claim 29, wherein the at least one surface treatment exhibits a nonwet or low-wettability finish in aqueous fluids.

43. The rotary drill bit of claim 29, wherein at least a portion of the at least one surface treatment comprises a nonmetallic material.

44. The rotary drill bit of claim 43, wherein the nonmetallic material is selected from the group comprising: polymers, PTFE, FEP, PFA, ceramics and plastics.

45. The rotary drill bit of claim 43, wherein at least a portion of the nonmetallic material is filled with a metallic material.

46. The rotary drill bit of claim 43, wherein the nonmetallic material at least partially fills a porous material selected from the group comprising metals, alloys, cermets and ceramics.

47. The rotary drill bit of claim 43, wherein the nonmetallic material is selected from the group comprising: polymers, PTFE, FEP, PFA and plastics.

48. The rotary drill bit of claim 47, wherein the nonmetallic material is at least partially filled with a metallic material.

49. The rotary drill bit of claim 47, wherein the nonmetallic material at least partially fills a porous material selected from the group comprising metals, alloys, cermets and ceramics.

50. The rotary drill bit of claim 29, wherein the at least one surface treatment comprises at least one layer of a nonmetallic, hard facing material.

51. The rotary drill bit of claim 50, wherein the nonmetallic, hard facing material is selected from the group comprising diamond film, monocrystalline diamond, polycrystalline diamond, diamond-like carbon, nanocrystalline carbon, vapor-deposited carbon, cubic boron nitride and silicon nitride.

52. The rotary drill bit of claim 29, wherein the at least one surface treatment includes at least one layer of metallic material.

53. The rotary drill bit of claim 52, wherein the metallic material is selected from the group comprising nickel, chromium, copper, magnesium, cobalt, precious metals, noble metals, and combinations and alloys of each of the foregoing.

54. The rotary drill bit of claim 29, wherein the at least one surface treatment is carried on a surface of at least one insert carried by at least one of the at least one leg and an interior surface of the roller-cone.

55. The rotary drill bit of claim 29, wherein the at least one surface treatment is configured as at least one insert carried by at least one of the at least one leg and an interior surface of the roller-cone.

* * * * *

UNITED STATES PATENT AND TRADEMARK OFFICE

CERTIFICATE OF CORRECTION

PATENT NO. : 6,450,271 B1
DATED : September 17, 2002
INVENTOR(S) : Gordon A. Tibbitts et al.

It is certified that error appears in the above-identified patent and that said Letters Patent is hereby corrected as shown below:

Column 2,
Line 48, change " "polycrytalline" " to -- polycrystalline --.

Column 4,
Line 9, change "in FIG. 3" to -- in FIG. 2 --.

Column 8,
Line 12, change "ortion" to -- portion --.
Line 56, change "thereofAs" to -- thereof. As --.

Column 10,
Line 20, after "of" and before "bushing" insert -- tubular --.

Column 11,
Line 57, after "interface" delete "30'".

Column 12,
Line 44, change "chip 126" to -- formation chip 126 --.

Signed and Sealed this

Twentieth Day of September, 2005

JON W. DUDAS
*Director of the United States Patent and Trademark Office*